United States Patent [19]

Lamb

[11] 4,024,586

[45] May 24, 1977

[54] HEADGEAR SUSPENSION SYSTEM

[75] Inventor: Matthew J. Lamb, Newtown, Pa.

[73] Assignee: The United States of America as represented by the Secretary of the Navy, Washington, D.C.

[22] Filed: Aug. 5, 1976

[21] Appl. No.: 711,944

[52] U.S. Cl. ..... 2/414

[51] Int. Cl.[2] ..... A42B 3/02

[58] Field of Search ..... 2/414, 415, 411, 412, 2/413, 423, 6

[56] References Cited

UNITED STATES PATENTS

| | | | |
|---|---|---|---|
| 3,673,609 | 7/1972 | DeSimone | 2/414 |
| 3,789,427 | 2/1974 | Aileo | 2/423 |
| 3,806,950 | 4/1974 | Spencer-Foote | 2/413 |
| 3,882,546 | 5/1975 | Morton | 2/413 |
| 3,882,547 | 5/1975 | Morgan | 2/414 |

FOREIGN PATENTS OR APPLICATIONS

| | | | |
|---|---|---|---|
| 1,378,494 | 12/1974 | United Kingdom | 2/414 |

*Primary Examiner*—Alfred R. Guest
*Attorney, Agent, or Firm*—R. S. Sciascia; Henry Hansen; William J. Iseman

[57] ABSTRACT

A selectable plurality of removable pads are placed one on top of another fore and aft between a rigid helmet and an inner flexible helmet for fitting and suspending a single size of the rigid helmet to varying head contours. The pads are comprised of ventilated spacer material having attached on opposing surfaces thereof mating fastening elements for securing the pads both to each other and between the rigid and flexible helmets. The pads provide for ventilation and cooling and stabilize the rigid helmet on the head.

5 Claims, 3 Drawing Figures

HEADGEAR SUSPENSION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to headgear suspension systems and in particular to a selectable sizing apparatus which permits the use of a single size rigid helmet with a variety of head sizes and contours and for additionally providing cooling and ventilation within the rigid helmet and stabilization between the rigid helmet and a flexible helmet positioned on the wearer's head.

Personnel engaged in aircraft flying activities such as pilots and crewmembers often require the utilization of headgear for protection against head injuries and also for incorporation of various electronics such as communications and automatic targeting systems. Heretofore the varying contours of human heads required to be fitted with a helmet necessitated the storage and application of a wide variety of corresponding rigid helmet sizes and corresponding internal flexible helmets which are customarily worn in intimate contact with the head and which are conventionally attached to the rigid helmet by a plurality of appropriately positioned suspension straps and snap fasteners. In order to provide a better form fit about the wearer's head and the internal flexible helmet, the outer rigid helmet is conventionally lined and padded with a layer of foam-like material which, although providing a better fit to the user, inhibits airflow and permits slippage between the outer and inner helmets. Modern aircraft weapon systems, in one example, incorporate a visual target acquisition system which provides a target sight on a visor attached to the rigid helmet and which sight is initially aligned and boresighted before take-off with the rigid helmet in place on the pilot's head. Such systems require that the movement of the outer rigid helmet be carefully coordinated with the movement of the pilot's head in order to insure target accuracy and continued reliability of the target acquisition system during flight operations.

SUMMARY OF THE INVENTION

Accordingly, it is an object of the present invention to provide a headgear suspension system that will permit the fitting of a single, predetermined contour rigid helmet to a wide variety of head contours. Another object of the invention is to maintain cooling in the space formed between the external rigid helmet and an internal flexible helmet by minimizing resistance to air flow. Yet another object of the present invention is to provide rigid helmet stability on the wearer's head.

Briefly, these and other objects are accomplished by a headgear suspension system having a plurality of removable pads which are placed one on top of another fore and aft on the cranial roof of the wearer between a rigid external helmet and an internal flexible helmet for permitting the fitting and suspension of a single size rigid helmet on varying head sizes and contours. The pads are comprised of ventilated spacer material formed in substantially rectangular strips having attached on opposing surfaces thereof mating fastening elements for securing the pads both to each other and between the rigid and flexible helmets. The pads are ventilated to permit airflow and cooling between the helmets and to stabilize the rigid helmet on the head.

For a better understanding of these and other aspects of the invention, reference may be made to the following detailed description taken in conjunction with the accompanying drawings.

DESCRIPTION OF THE PREFERRED EMBODIMENT

Figure 1:
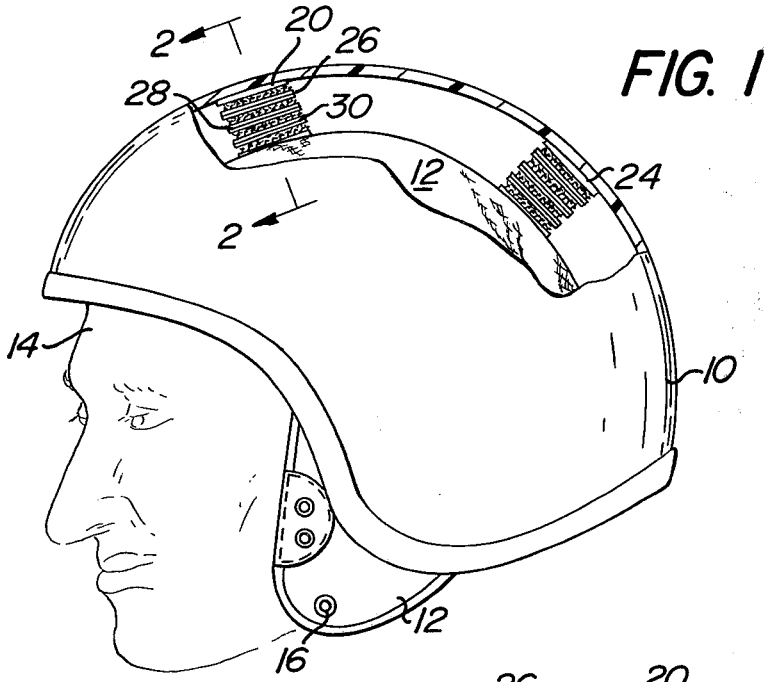
FIG. 1 is a side elevation view shown in fragmented section of a headgear suspension system constructed according to the present invention.

Referring now to FIG. 1 there is shown a rigid helmet 10 having internal thereto a flexible helmet 12 fitted over a human head 14 and positioned in conformance with the contours thereof. The flexible helmet 12 is stabilized and secured to the head 14 in any conventional manner such as a chin strap (not shown) attachable by means of a tie point 16.

Figure 2:
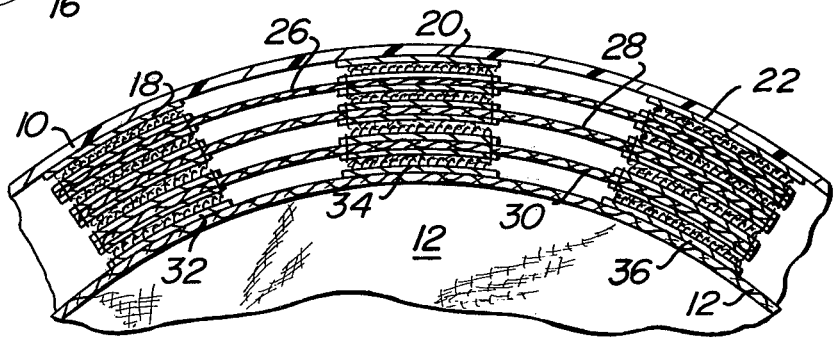
FIG. 2 is a sectional view taken along the lines 2—2 noted in FIG. 1 of a portion of the headgear system according to the present invention.

Referring now to FIG. 2 there is shown a sectional view of a portion of the headgear suspension system of the present invention taken along the lines 2—2 noted in FIG. 1. In the preferred embodiment, the system comprises a series of spacer pads stacked one on top of the other in both fore and aft positions secured between the rigid helmet 10 and the flexible helmet 12. In order to attach the pads to the interior of the rigid helmet 10, a plurality of loop fastening elements 18, 20, 22 are bonded by any convenient means such as glue or epoxy to the interior of the helmet 10 in the positions shown. A plurality of spacer fabrics 26, 28, and 30 are shown stacked one upon the other in the forward position of the cranial roof as noted in FIG. 1 between the rigid helmet 10 and the flexible helmet 12. A similar stack of three spacer fabrics are shown in FIG. 1 at the aft portion of the cranial roof. A plurality of hook fastening elements 32, 34, 36 are attached to the flexible helmet 12 in any conventional manner such as stitching or glue so as to be in registration with the corresponding loop fastening elements 18, 20, 22. Each of the spacer fabrics 26, 28, 30 are sequentially attached to one another in a stacked pattern and are ultimately attached to either the rigid helmet 10 or the flexible helmet 12 by respective pluralities of fastening elements shown in greater detail in FIG. 3.

Figure 3:
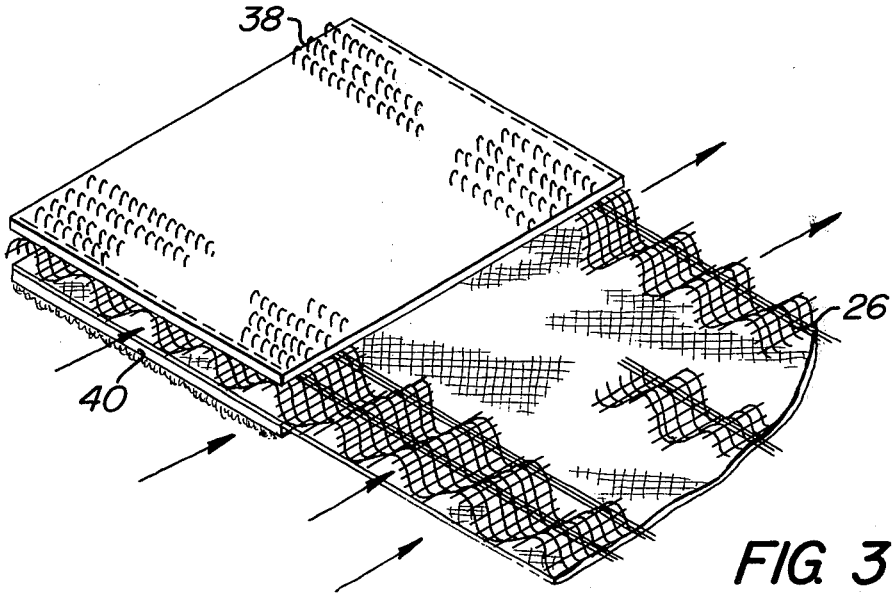
FIG. 3 is a perspective view of a portion of a spacer pad used in the headgear suspension system of the present invention.

Referring now to FIG. 3, a portion of a representative spacer pad as used in the present invention and which is shown in both FIGS. 1 and 2 comprises a ventilated spacer fabric 26 having a corrugated cross-section adapted to permit the omnidirectional flow of air therethrough such as noted in one direction by the arrows in the drawing and having on one side thereof a hook fastening element patch 38 and on the other side thereof a loop fastening element patch 40. In the preferred embodiment, each of the spacer pads comprises a single rectangular strip of spacer fabric and interengageable fastener elements such as 38 and 40 positioned at the end points of the fabric strip and at an intermediate point therebetween.

Referring now to FIGS. 1–3, the operation of the invention will be explained. The head 14 is first fitted in conformity with the flexible helmet 12 which is stabilized with the head by means of a conventional chin strap attached to the tie point 16. The rigid helmet 10 in one fitting method, for example, is then placed over the flexible helmet 12 and initially adjusted for a comfortable fitting wherein the top fore portion of the helmet is positioned approximately one-half inch away from the forehead. An estimate of the quantity of spacer pads required to suspend and maintain the helmet in this position is then made and the pads are selectively installed fore and aft over the cranial roof in a stacked manner between the flexible helmet 12 and the interior of the rigid helmet 10. The pads are built up layer by layer and connected to both each other and to the respective helmets by means of the pressure actuatable interengageable fastening elements positioned in the areas noted in FIG. 1 as extending over the fore and aft portions of the cranial roof and substantially in parallel alignment with an imaginary line drawn between the ears of the wearer. Each of the stacks of spacer pads is individually and selectively adjusted to provide the correct sizing of the rigid helmet to the contour of the head 14. The fastening elements are conventional and are commercially available, for example, under the tradename "Velcro". Although in the preferred embodiment, the hook fastening elements are shown being positioned in a direction outward from the head 14 and the loop fastening elements are shown in the opposite direction, the hooks and loops of the fastening elements may be interchanged if desired. Moreover, although there are shown a plurality of three differing attachment points for the fastening elements across each of the respective spacer pads, a single patch of a sufficiently large size of fastening elements may be attached to each of the spacer fabrics and achieve the intended use of the invention. The spacer fabric is a composite of synthetic materials formed in a ventilated shape and which shape, although measuring in one example one-eighth inch thickness, is not easily displaced under shear stresses. One example of such a materialis available commercially and known as space fabric manufactured by Uniroyal of Winnsboro, South Carolina. Due to the fact that the spacer fabrics and the respective corresponding fastening elements are all highly resistive to shear forces, the rigid helmet 10 is stabilized and locked in coordination with the motion of the flexible helmet 12 and, ultimately, the head 14. Additionally, the free flow of air is permitted between the outer rigid helmet 10 and the inner flexible helmet 12 through the corrugated cross-section provided in each of the spacer strips so as to provide cooling and ventilation for the pilot as well as increasing comfort in wearing the helmets.

Thus it may be seen that there has been provided a novel headgear suspension system for permitting the fitting of a single helmet size to a variety of differently sized human heads and also for maintaining cooling and comfort in the wearing of the helmet assembly and for stabilizing a rigid helmet upon the wearer's head.

Obviously, many modifications and variations of the invention are possible in light of the above teachings. It is therefore to be understood that within the scope of the appended claims the invention may be practiced otherwise than as specifically described.

What is claimed is:

1. A headgear suspension system for adaptively fitting a rigid helmet having a predetermined contour to a plurality of differing head contours, comprising, in combination:

a flexible helmet adapted to fit relatively closely to respective ones of the plurality of head contours;

a plurality of discrete corrugated spacers formed in two stacks, each of said stacks having at least two elongated spacer strips positioned parallel to a line drawn between the ears of the head and operatively secured front and rear on the cranial roof thereof and adapted to be disposed intermediate said flexible helmet and the rigid helmet for ventilating and selectively varying the space between said flexible helmet and the rigid helmet to cause the rigid helmet to adaptively fit differing ones of the head contours; and pressure actuatable interengageable securing means formed to be attached on the inside of the rigid helmet and attached on the outside of said flexible helmet and on respective ones of said spacers for stabilizing the position of the rigid helmet relative to said flexible helmet and respective ones of the head contours and for inhibiting relative movement between said helmets.

2. A system according to claim 1 wherein said securing means are attached to each of said elongated spacer strips intermediate and near the ends thereof.

3. A headgear suspension system for adaptively fitting a plurality of differing head contours, comprising, in combination:

a flexible helmet adapted to fit relatively closely to respective ones of the plurality of head contours;

a rigid helmet having a predetermined contour and disposed outwardly of and extending over said flexible helmet;

a plurality of discrete corrugated spacers formed in two stacks, each of said stacks having at least two elongated spacer strips positioned parallel to a line drawn between the ears of the head and operatively secured front and rear on the cranial roof thereof and disposed intermediate said helmets for ventilating and selectively varying the space between said helmets to cause said rigid helmet to adaptively fit differing ones of the head contours; and pressure actuatable interengageable securing means attached on the inside of said rigid helmet, the outside of said flexible helmet and on respective ones of said spacers for stabilizing the position of said rigid helmet relative to said flexible helmet and respective ones of the head contours and for inhibiting relative movement between said helmets.

4. A system according to claim 3 wherein said securing means are attached to each of said elongated spacer strips near and intermediate the ends thereof.

5. A headgear suspension system for adaptively fitting a plurality of differing head contours, comprising, in combination:

a flexible helmet adapted to fit relatively closely to respective ones of the plurality of head contours;

a rigid helmet having a predetermined contour and disposed outwardly of an extending over said flexible helmet; and a least one stack of spacers disposed intermediate said helmets and extending over selected portions of the cranial roof of respective ones of the head contours, each of said stacks comprising one or more layers of said spacers registeringly attached to adjacent spacers or to selected portions of said helmets for selectively varying the space between said helmets and for inhibiting relative movement therebetween and to cause said rigid helmet to adaptively fit differing ones of the head contours.

* * * * *